US008427515B2

(12) United States Patent
Kim et al.

(10) Patent No.: US 8,427,515 B2
(45) Date of Patent: Apr. 23, 2013

(54) DISPLAY DEVICE AND METHOD OF DRIVING THE SAME

(75) Inventors: Hee-Seop Kim, Hwaseong-si (KR); Jun-Woo Lee, Anyang-si (KR); Hong-Jo Park, Suwon-si (KR); Eun-Hee Han, Seoul (KR); Seung-Hoon Lee, Yongin-si (KR); Sung-Jae Yun, Yongin-si (KR)

(73) Assignee: Samusng Display Co., Ltd. (KR)

( * ) Notice: Subject to any disclaimer, the term of this patent is extended or adjusted under 35 U.S.C. 154(b) by 1510 days.

(21) Appl. No.: 11/950,126

(22) Filed: Dec. 4, 2007

(65) Prior Publication Data

US 2008/0129673 A1 Jun. 5, 2008

(30) Foreign Application Priority Data

Dec. 4, 2006 (KR) ..... 10-2006-0121185

(51) Int. Cl.
*G09G 5/10* (2006.01)

(52) U.S. Cl.
USPC ..... 345/691; 345/94; 345/102

(58) Field of Classification Search ..... 345/89, 345/94, 95, 102, 204, 690, 691; 362/97.1–97.3
See application file for complete search history.

(56) References Cited

U.S. PATENT DOCUMENTS

| | | | | |
|---|---|---|---|---|
| 6,573,882 | B1 * | 6/2003 | Takabayashi | 345/102 |
| 6,809,717 | B2 * | 10/2004 | Asao et al. | 345/102 |
| 7,038,651 | B2 * | 5/2006 | Nitta et al. | 345/98 |
| 7,486,265 | B2 * | 2/2009 | Hosaka et al. | 345/88 |
| 7,746,294 | B2 * | 6/2010 | Lee et al. | 345/30 |
| 7,800,691 | B2 * | 9/2010 | Oyaizu et al. | 348/441 |
| 2003/0006952 | A1 | 1/2003 | Hong | |
| 2003/0058229 | A1 * | 3/2003 | Kawabe et al. | 345/204 |
| 2004/0239612 | A1 * | 12/2004 | Asao et al. | 345/102 |
| 2005/0052388 | A1 * | 3/2005 | Handschy et al. | 345/89 |
| 2005/0184944 | A1 * | 8/2005 | Miyata et al. | 345/89 |
| 2006/0176261 | A1 * | 8/2006 | Nitta et al. | 345/94 |
| 2006/0214897 | A1 | 9/2006 | Murai | |
| 2007/0103418 | A1 * | 5/2007 | Ogino et al. | 345/89 |

FOREIGN PATENT DOCUMENTS

| | | |
|---|---|---|
| JP | 07-294881 | 11/1995 |
| JP | 2004-240317 | 8/2004 |
| JP | 2004-302270 | 10/2004 |
| JP | 2006-113156 | 10/2004 |
| JP | 2005092113 A | 4/2005 |
| JP | 2005-173387 | 6/2005 |
| JP | 2005-234552 | 9/2005 |
| JP | 2006-011427 | 1/2006 |
| JP | 2006-209127 | 8/2006 |
| JP | 2006-221060 | 8/2006 |
| JP | 2006-267303 | 10/2006 |
| JP | 2007-133051 | 5/2007 |
| JP | 2008-076433 | 4/2008 |
| KR | 2006-045276 | 11/2004 |
| KR | 2006-076488 | 12/2004 |
| WO | 2005/038766 | 4/2005 |

* cited by examiner

*Primary Examiner* — Tom Sheng
(74) *Attorney, Agent, or Firm* — Innovation Counsel LLP

(57) ABSTRACT

Disclosed are a display device and a method of driving the same that improve both moving image visibility and lateral visibility. A display panel including gate and data lines arranged in the form of a matrix for displaying an image, a gate driver for driving the gate line, and a data driver for supplying a low gray scale image signal, a high gray scale image signal, and a black impulsive signal to the data line within one frame period.

29 Claims, 4 Drawing Sheets

DISPLAY DEVICE AND METHOD OF DRIVING THE SAME

CROSS-REFERENCE TO RELATED APPLICATION

This application claims priority to Korean Patent Application No. 10-2006-0121185, filed on Dec. 4, 2006, the disclosure of which is hereby incorporated herein by reference in its entirety for all purposes.

BACKGROUND OF THE INVENTION

1. Field of the Invention

The present invention relates to a display device and, more particularly, to a display device having improved moving image and lateral visibility.

2. Description of the Related Art

Generally, a liquid crystal display ("LCD") device includes an LCD panel that comprises a thin film transistor ("TFT") substrate on which TFTs are formed, a color filter substrate on which a color filter layer is provided, and a liquid crystal layer disposed between the substrates. Since the LCD panel is a non-emissive element, a backlight unit is provided on a rear side of the TFT substrate to supply light. Transmissivity of the light supplied from the backlight unit is controlled according to the alignment state of the liquid crystal layer.

Such an LCD device may include an alignment layer to align the liquid crystal layer in a specific direction. In this case, the alignment layer is rubbed in a predetermined direction.

However, in the LCD device subjected to the rubbing process, a lateral image viewed in a direction substantially parallel to the rubbing direction fails to match another lateral image viewed in a direction substantially perpendicular to the rubbing direction. This is called a lateral visibility asymmetry, and it is required to solve such a phenomenon in the LCD device subjected to the rubbing process.

Moreover, the LCD device has low moving image visibility, compared with a cathode ray tube (CRT) device, which is a major problem in the LCD device to be solved to expand its market share in the television market.

BRIEF SUMMARY OF THE INVENTION

Accordingly, the present invention provides a display device and a method of driving the same that improve both moving image and lateral visibility of the display device.

In accordance with an aspect of the present invention, there is provided a display device including: a display panel including gate and data lines arranged in the form of a matrix for displaying an image; a gate driver for driving the gate line; and a data driver for supplying a low gray scale image signal, a high gray scale image signal, and a black impulsive signal to the data line within one frame period.

Preferably, the data driver divides one frame period into first to third sub-frames, selects one of the low gray scale image signal, the high gray scale image signal and the black impulsive signal at every sub-frame, and then supplies the selected signal to the data line.

The data driver supplies the black impulsive signal to the last sub-frame in the first to third sub-frames so as to improve the moving image visibility.

Preferably, an average value between the low and high gray scale image signals is equal to a normal gray scale image signal so as to improve the lateral visibility asymmetry problem.

The low gray scale image signal has a gray luminance value at a gray scale lower than an intermediate gray scale in all gray scales.

In addition, the black impulsive signal has a black gray scale voltage value.

The data driver divides one frame period into first to fourth sub-frames, selects one of the low gray scale image signal, the high gray scale image signal, the black impulsive signal and a compensation signal corresponding to the black impulsive signal at every frame, and supplies the selected signal to the data line.

An average value between the low and high gray scale image signals is equal to a normal gray scale image signal.

In accordance with another aspect of the present invention, there is provided a display device comprising: a display panel having gate and data lines arranged in the form of a matrix for displaying an image; a backlight unit for supplying light to the display panel; a gate driver for driving the gate line; a data driver for supplying a low gray scale image signal and a high gray scale image signal to the data line within one frame period; and a backlight driver for turning off the backlight unit for a predetermined time within the one frame period.

The data driver divides one frame period into first and second sub-frames, and applies one of the low gray scale image signal and the high gray scale image signal to each of the sub-frames.

The backlight driver turns on the backlight unit from a start time point of one frame period to a black impulsive time point and turns off the backlight unit from the black impulsive time point to an end time point of one frame period.

The black impulsive time point is over an intermediate time point of one frame period.

In accordance with a still another aspect of the present invention, there is provided a method of driving a display device, comprising: dividing one frame period charging a pixel with a pixel voltage into a plurality of sub-frames; applying a gray impulsive signal to sub-frames of a first group selected from the plurality of sub-frames; and applying a black impulsive signal to sub-frames of a second group selected from the plurality of sub-frames, different from the first group.

Preferably, the gray impulsive signal includes a low gray scale image signal and a high gray scale image signal, and an average value between the low and high gray scale image signals is equal to a normal gray scale image signal.

In accordance with a further aspect of the present invention, there is provided a method of driving a display device, comprising: dividing one frame charging a pixel with a pixel voltage into a first sub-frame and a second sub-frame; supplying one signal selected from the group consisting of a low gray scale image signal and a high gray scale image signal to each of the sub-frames; and turning off a backlight unit for a specific time in every one frame period.

Preferably, in the turning off the backlight unit, the backlight unit is turned on from a start time point of one frame period to a black impulsive time point and turned off from the black impulsive time point to an end time point of one frame period.

BRIEF DESCRIPTION OF THE DRAWINGS

The features of the present invention will become more apparent to those of ordinary skill in the art by describing in detail exemplary embodiments thereof with reference to the attached drawings, in which.

Use of the same reference symbols in different figures indicates similar or identical items.

DETAILED DESCRIPTION OF THE INVENTION

First, a display device according to an exemplary embodiment of a first aspect of the present invention will be described with reference to FIG. 1, a block diagram of a display device according to a first exemplary embodiment of the present invention.

Figure 1:
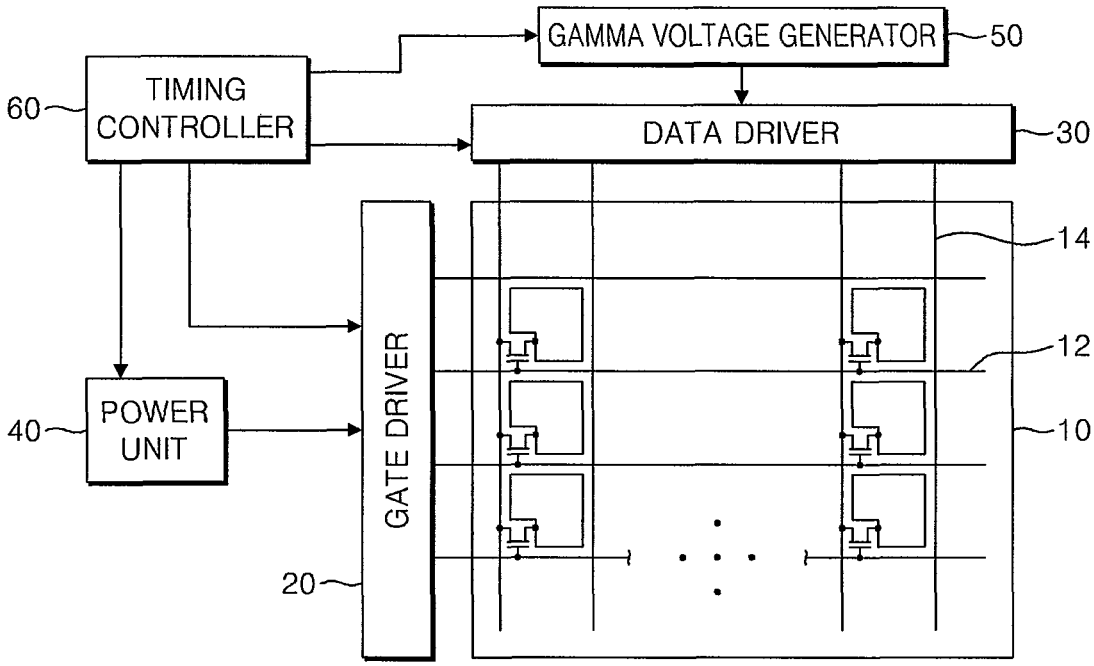
FIG. 1 is a block diagram of a display device according to a first exemplary embodiment of the present invention.

As shown in FIG. 1, the display device includes a display panel 10, a gate driver 20, a data driver 30, a power unit 40, a gamma voltage generator 50, and a timing controller 60.

The display panel 10 may include an active matrix type display panel such as an LCD panel, an organic light-emitting display panel, or the like. However, the LCD panel is taken as an example of the display panel 10 in the present embodiment. Accordingly, the display panel 10 includes a thin film transistor ("TFT") substrate, a color filter substrate facing the TFT substrate, and a liquid crystal layer disposed between the two substrates.

In the TFT substrate, a gate line 12 is formed on an insulating substrate. The gate line 12 may include a metal single layer or a metal multi-layer. A gate electrode is connected to the gate line 12. In a specific case, a storage line is further provided parallel to the gate line 12.

A gate insulating layer made of silicon nitride ($SiN_x$) or silicon oxide ($SiO_x$) covers the gate line 12 and the gate electrode on the substrate. A semiconductor layer made of amorphous silicon, or the like is formed on the gate insulating layer overlapping the gate electrode. An ohmic contact layer made of silicide or n+ hydrogenated amorphous silicon doped with n-type impurities is formed on the semiconductor layer. In particular, the ohmic contact layer is divided into two parts based on the gate electrode.

Source and drain electrodes and a data line 14 are formed on the ohmic contact layer and the gate insulating layer. The source and drain electrodes and the data line 14 are formed of a metal layer in a single layer or multi-layer. The data line 14 formed in the vertical direction intersects the gate line 12. One end of the source electrode is connected to the data line 14 and the other end of the source electrode is formed on the ohmic contact layer. The drain electrode is arranged to face the source electrode in which one end of the drain electrode is formed on the ohmic contact layer. The ohmic contact layer on which the one end of the source electrode is formed is spaced apart from the ohmic contact layer on which the one end of the drain electrode is formed.

A passivation layer is formed on the source and drain electrodes and the data line 14. The passivation layer may be an organic passivation layer or an inorganic passivation layer and may be formed in a double layer in which an organic passivation layer is formed on the inorganic passivation layer.

A pixel electrode is formed on the passivation layer. A portion of the pixel electrode penetrates the passivation layer to be connected to the drain electrode. In general, the pixel electrode is formed of a transparent insulating material such as indium-tin-oxide (ITO), indium-zinc-oxide (IZO), etc. The pixel electrode may be formed with various patterns such as a cutting pattern to improve a viewing angle.

A black matrix is formed on an insulating substrate of the color filter substrate. The black matrix normally segregates red, green and blue color filters and plays a role in cutting off direct light irradiation to the TFTs on the TFT substrate. Accordingly, the black matrix may be formed of a photosensitive organic material to which a black pigment is added. In this case, the black pigment includes carbon black, titanium oxide, etc.

Red (R), green (G) and blue (B) color filters are repeatedly arranged by taking the black matrix as a boundary. The color filters provide colors to light irradiated from a backlight unit and passing through the liquid crystal layer. The color filters may be formed of a photosensitive material. Meanwhile, the color filters may be formed on the TFT substrate. The color filters are provided on the pixel areas defined by the intersections between the gate lines 12 and the data lines 14.

An overcoat layer is further formed on the color filters and the black matrix which is not covered with the color filter layer. The overcoat layer planarizes the top surface of the color filter layer and protects the color filter layer. The overcoat layer is usually formed of an acryl based epoxy material.

A common electrode is formed on the overcoat layer. The common electrode is formed of a transparent conductive material such as ITO, IZO, etc. The common electrode directly applies a voltage to the liquid crystal layer together with the pixel electrode on the TFT substrate. The common electrode may also be formed with a pattern such as a cutting pattern to improve the viewing angle. The common electrode may be formed on the TFT substrate. In an LCD device that generates a horizontal electric field, not a vertical electric field, the common electrode is formed on the same substrate as the pixel electrode to generate the horizontal electric field.

The liquid crystal layer is disposed between the TFT substrate and the color filter substrate. The liquid crystal layer may include one of liquid crystals in various modes such as optical compensated band (OCB), in-plane switching (IPS), vertical alignment (VA), fringe-field switching (FFS), and twisted nematic (TN) modes.

The power unit 40 generates a gate-on voltage Von to turn on the TFT, a gate-off voltage Voff to turn off the TFT, and a common voltage Vcom applied to the common electrode. In this case, the gate-on voltage Von includes a positive polarity gate-on voltage Von(+) and a negative polarity gate-on voltage Von(−) lower than the positive polarity gate-on voltage Von(+).

The gamma voltage generator 50 generates a plurality of gray-scale voltages associated with luminance of the LCD device. A gray-scale voltage generated by the gamma voltage generator 50 is generated along one gamma curve that is determined by display panel. The gray-scale voltages generated according to the normal gamma curves are called normal gray-scale voltages.

The gate driving unit 20, called a scan driver, is connected to the gate line 12 to apply a gate signal including the gate-on voltage Von and the gate-off voltage Voff from the power unit 40 to the gate line 12.

The data driver 30, called a source driver, receives the gray-scale voltages from the gamma voltage generator 50, selects one of the gray-scale voltages under the control of the timing controller 60, and then applies a data voltage Vd to the data line 14.

Finally, the timing controller 60 generates control signals controlling operations of the gate driver 20, the data driver 30, the power unit 40, and the gamma voltage generator 50, and then supplies the same to the gate driver 20, the data driver 30, the power unit 40 and the gamma voltage generator 50, respectively.

Operations of the LCD device according to the present invention and a driving method thereof will be described in detail as follows.

First, the timing controller 60 receives RGB gray scale signals and control input signals for controlling the display of the RGB gray scale signals from an external graphic controller. For instance, the control input signals include a vertical synchronizing signal Vsync, a horizontal synchronizing signal Hsync, a main clock CLK, a data enable signal DE, etc.

The timing controller 60 generates a gate control signal, a data control signal, and a voltage selection control signal VSC based on the control input signals and converts the RGB gray scale signals received from the outside appropriately to meet the operational conditions of the LCD panel. The timing controller 60 supplies the gate control signal to the gate driver 20 and the power unit 40 and supplies the data control signal and processed gray scale signals to the data driver 30. The timing controller 60 also supplies the voltage selection control signal VSC to the gamma voltage generator 50.

The gate control signal includes a vertical synchronization start signal STV indicating an output start of a gate-on pulse (high level of the gate signal), a gate clock signal controlling an output start timing of the gate-on pulse, a gate-on enable signal OE limiting the width of the gate-on pulse, etc.

The data control signal includes a horizontal synchronization start signal STH for indicating an input start of the gray scale signals, a load signal LOAD for applying a corresponding data voltage Vd to the data line 14, a reverse control signal RVS for reversing the polarity of the data voltage, a data clock signal HCLK, etc.

The gamma voltage generator 50 supplies a gray scale voltage having a voltage value determined according to the voltage selection control signal VSC to the data driver 30. In the present embodiment, the gamma voltage generator 50 generates various gray scale voltages, not one gray scale voltage.

Next, the gray scale voltages generated by the gamma voltage generator 50 and the image signal generated by the data driver 30 in accordance with the present embodiment will be described in detail with reference to two examples.

Figure 2:
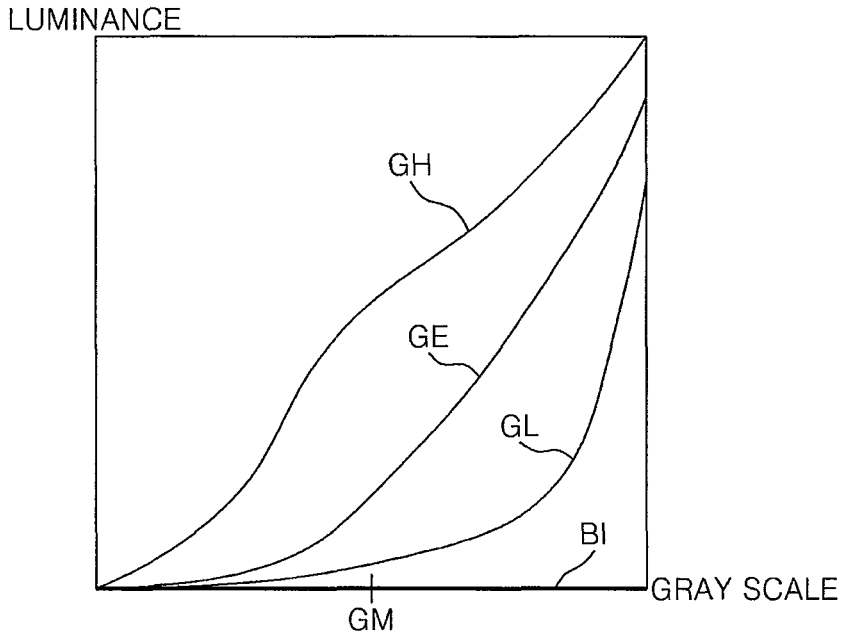
FIG. 2 is a graph illustrating an example of gamma voltages generated from a gamma voltage generator shown in FIG. 1.

According to the first example, as shown in FIG. 2, the gamma voltage generator 50 generates three kinds of gray scale voltages including a high gray scale voltage GH, a low gray scale voltage GL, and a black impulsive voltage BI. FIG. 2 is a graph illustrating an example of gamma voltages generated from the gamma voltage generator 50 shown in FIG. 1. The high gray scale voltage GH and the low gray scale voltage GL correspond to values obtained by dividing a normal gray scale voltage GE by a gray scale voltage higher than the normal gray scale voltage and by a gray scale voltage lower than the normal gray scale voltage, respectively. That is, the high gray scale voltage GH is higher than a normal gray scale voltage GE, and the low gray scale voltage LH is lower than the normal gray scale voltage GE, in which an average value between the high and low gray scale voltages GH and GL is equal to the normal gray scale voltage GE. The normal gray scale voltage GE is the common gray scale voltage generated according to a normal gamma curve by the voltage selection control signal VSC applied from the timing controller 60.

The gamma voltage generator 50 according to the present embodiment does not generate the normal gray scale voltage, but generates the high gray scale voltage GH and the low gray scale voltage GL corresponding to the normal gray scale voltage GE. The reason for the generation of the high and low gray scale voltages GH and GL is to solve the lateral visibility asymmetry problem by driving the liquid crystal layer in various ways. The high and low gray scale voltages GH and GL generated by the gamma voltage generator 50 are used to determine an image signal in the data driver 30.

Although the low and high gray scale voltages GL and GH may be freely generated within the range that the average value of the low and high gray scale voltages GL and GH is equal to the normal gray scale voltage GE, it is preferable that, as shown in FIG. 2, the low gray scale voltage GL has a gray luminance value at a gray scale lower than an intermediate gray scale GM in all gray scales. In this case, the gray luminance value denotes a voltage value indicating gray, not black. The reason for this is that it is possible to improve the luminance when the low gray scale voltage GL does not have a black luminance value, if possible.

The gamma voltage generator 50 according to the present embodiment generates the black impulsive voltage BI. As shown in FIG. 2, the black impulsive voltage BI has a black luminance value in all gray scales. Accordingly, black is always displayed by the image signal generated according to the black impulsive voltage BI, and thereby an image is not displayed. The black impulsive voltage BI is generated for the improvement of the moving image visibility.

The thus-generated three kinds of the gray scale voltages are supplied to the data driver 30. The data driver 30 selects a specific value from the gray scale voltages according to the gray scale signal supplied from the timing controller 60 and then supplies the selected value to the data line 14 as an image signal.

In the present embodiment, one frame period is divided into three sub-frames to apply different image signals to the respective sub-frames. For convenience of description, three sub-frames are referred to as first to third sub-frames SF1, SF2 and SF3 in the time order, respectively.

The data driver 30 generates a high gray scale image signal GHS selected at the high gray scale voltage GH and corresponding to the gray scale signal supplied from the timing controller 60. Moreover, the data driver 30 generates a low gray scale image signal GLS selected at the low gray scale voltage GL and corresponding to the gray scale signal. The high and low gray scale image signals GHS and GLS are generated by the same gray scale signal and, if both signals are averaged, the average value becomes equal to a normal gray scale image signal GES generated at the normal gray scale voltage GE. Furthermore, the data driver 30 generates a black impulsive signal BIS by the black impulsive voltage BI as well.

Figure 3:
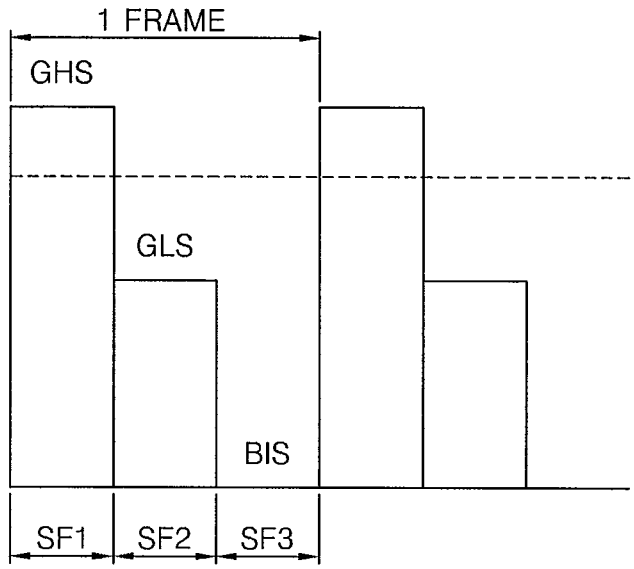
FIG. 3 is a configuration diagram illustrating image signals corresponding to the gamma voltages shown in FIG. 2.

The thus-generated high gray scale image signal GHS, low gray scale image signal GLS, and black impulsive signal BIS are applied to the first to third sub-frames SF1, SF2 and SF3, respectively. For instance, as shown in FIG. 3, the high gray scale image signal GHS is applied to the first sub-frame SF1, the low gray scale image signal GLS is applied to the second sub-frame SF2, and the black impulsive signal BIS is applied to the third sub-frame SF3. FIG. 3 is a configuration diagram of image signals corresponding to the gamma voltages shown in FIG. 2.

It is preferable that the black impulsive signal BIS be applied to the third sub-frame SF3 that is the last sub-frame in the three kinds of the sub-frames so as to effectively improve the moving image visibility. In order to improve the moving image visibility, it is necessary to provide a blackout in which the image previously displayed is turned off temporarily and black is displayed before a new image is displayed. Accordingly, the blackout, in which the image is not displayed by applying the black impulsive signal BIS to the third sub-frame SF3, which is just before the new frame is displayed, is provided before the new frame starts.

As described above, if the normal gray scale image signal GES is divided into the high gray scale image signal GHS and the low gray scale image signal GLS and displayed in one frame period for the same time, it is possible to display the same image signal as the normal gray scale image signal GES and, at the same time, solve the lateral visibility asymmetric problem. Meanwhile, the moving image visibility can be simultaneously improved by applying the black impulsive signal BIS to the last sub-frame.

Figure 4:
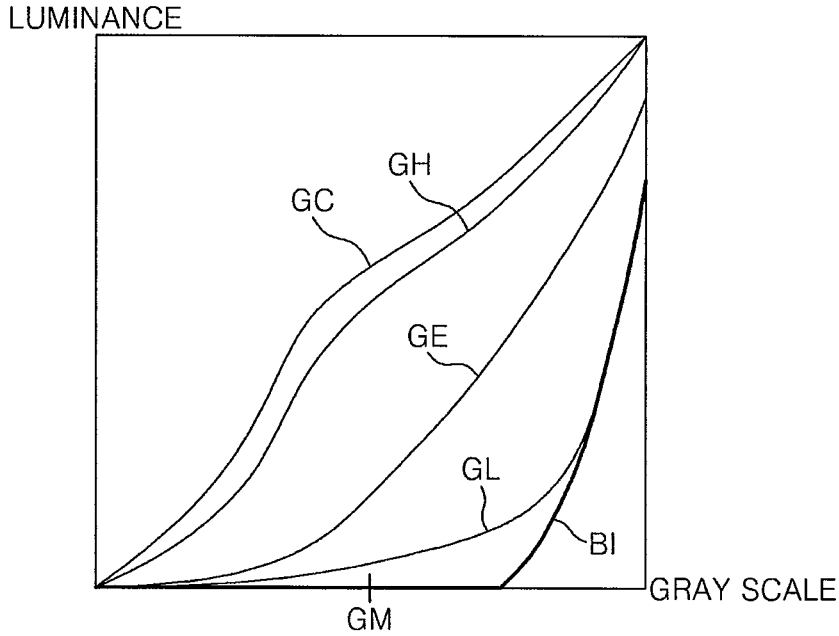
FIG. 4 is a graph illustrating another example of gamma voltages generated from the gamma voltage generator shown in FIG. 1.

Next, the second example will be described as follows. As shown in FIG. 4, the gamma voltage generator 50 generates four kinds of gray scale voltages including a low gray scale voltage GL, a high gray scale voltage GH, a black impulsive voltage BI, and a compensation gray scale voltage GC. FIG. 4 is a graph illustrating another example of gamma voltages generated from the gamma voltage generator shown in FIG. 1.

Since the low gray scale voltage GL and the high gray scale voltage GH are the same as described above, their description will not be repeated below. That is, the low gray scale voltage GL and the high gray scale voltage GH correspond to values obtained by dividing a normal gray scale voltage GE by two different gray scale voltages in order to improve the lateral visibility.

The black impulsive voltage BI is generated to improve the moving image visibility. As shown in FIG. 4, the black impulsive voltage BI has a black luminance value in general and a gray luminance value, not the black luminance value, at a gray scale higher than an intermediate gray scale GM. Accordingly, the black impulsive voltage BI displays black in most cases and an image only at a high gray scale. With such a structure that the black impulsive voltage BI does not have a black luminance value at all gray scales, but has a gray luminance value at a high gray scale, it is possible to reduce a decrease in transmissivity while improving the moving image visibility.

The gamma voltage generator 50 generates the compensation gray scale voltage GC as well. The compensation gray scale voltage GC is to compensate for the generation of the black impulsive voltage BI. In particular, as the average value between the high gray scale voltage GH and the corresponding low gray scale voltage GL results in the normal gray scale voltage GE, an average value between the compensation gray scale voltage GC and the corresponding black impulsive voltage BI results in the normal gray scale voltage GE. The reason for the generation of the compensation gray scale voltage GC is that the data driver 30 may apply the same signal value as the original gray scale signal applied to the data line 14 within one frame period.

The thus-generated four kinds of the gray scale voltages are supplied to the data driver 30. The data driver 30 selects a specific value from the gray scale voltages according to a gray scale signal received from the timing controller 60 and then supplies the same to the data line 14 as an image signal.

In the present embodiment, one frame period is divided into four sub-frames to apply different image signals to the respective sub-frames. For convenience of explanation, four sub-frames are referred to as first to fourth sub-frames SF1, SF2, SF3 and SF4 in the time order.

The data driver 30 generates a high gray scale image signal GHS selected at a high gray scale voltage GH and corresponding to the gray scale signal supplied from the timing controller 60. Moreover, the data driver 30 also generates a low gray scale image signal GLS selected at a low gray scale voltage GL and corresponding to the gray scale signal. Accordingly, if the high and low gray scale image signal GHS and GLS, generated from the same gray scale signal, are averaged, the average value between the high and low gray scale image signals GHS and GLS becomes the same as the normal gray scale image signal GES generated by the normal gray scale voltage GE.

The data driver 30 generates a black impulsive signal BIS by the black impulsive voltage BI. In addition, the data driver 30 generates a compensation signal GCS by a compensation gray scale signal GC. As described above, the data driver 30 generates four different kinds of image signals to be applied during one frame period.

Figure 5:
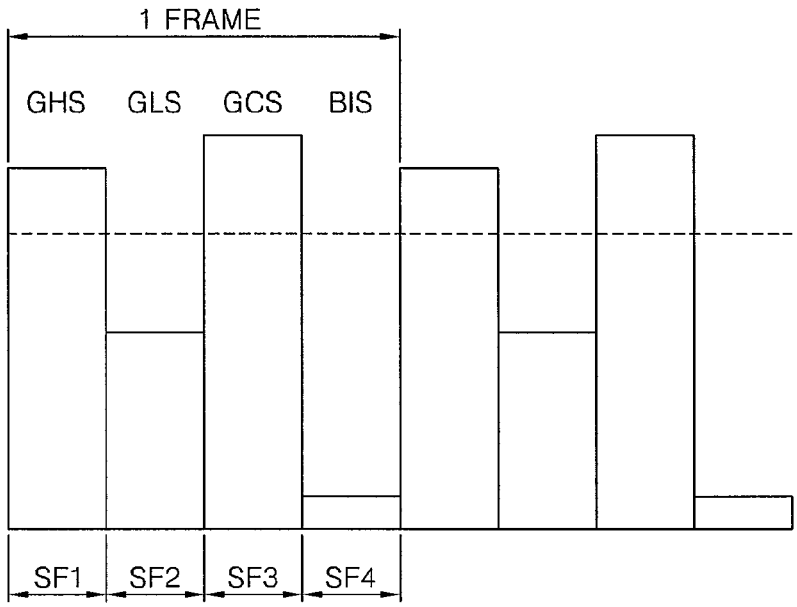
FIG. 5 is a configuration diagram illustrating image signals corresponding to the gamma voltages shown in FIG. 4.

The thus-generated high gray scale image signal GHS, low gray scale image signal GLS, black impulsive signal BIS, and compensation signal GCS are applied to the first to fourth sub-frames SF1, SF2, SF3 and SF4, respectively. For instance, as shown in FIG. 5, the high gray scale image signal GHS is applied to the first sub-frame SF1, the low gray scale image signal GLS is applied to the second sub-frame SF2, the compensation signal GCS is applied to the third sub-frame SF3, and the black impulsive signal BIS is applied to the fourth sub-frame SF4. FIG. 5 is a configuration diagram illustrating image signals corresponding to the gamma voltages shown in FIG. 4.

The black impulsive signal BIS is preferably applied to the fourth sub-frame SF4, which is the last sub-frame of the four kinds of the sub-frames, thus effectively improving the moving image visibility. In order to improve the moving image visibility, it is necessary to provide a blackout in which the image previously displayed is turned off temporarily and black is displayed before a new image is displayed. Accordingly, the blackout, in which the image is not displayed by applying the black impulsive signal BIS to the fourth sub-frame SF4, which is just before the new frame is displayed, is provided before the new frame starts.

Figure 6:
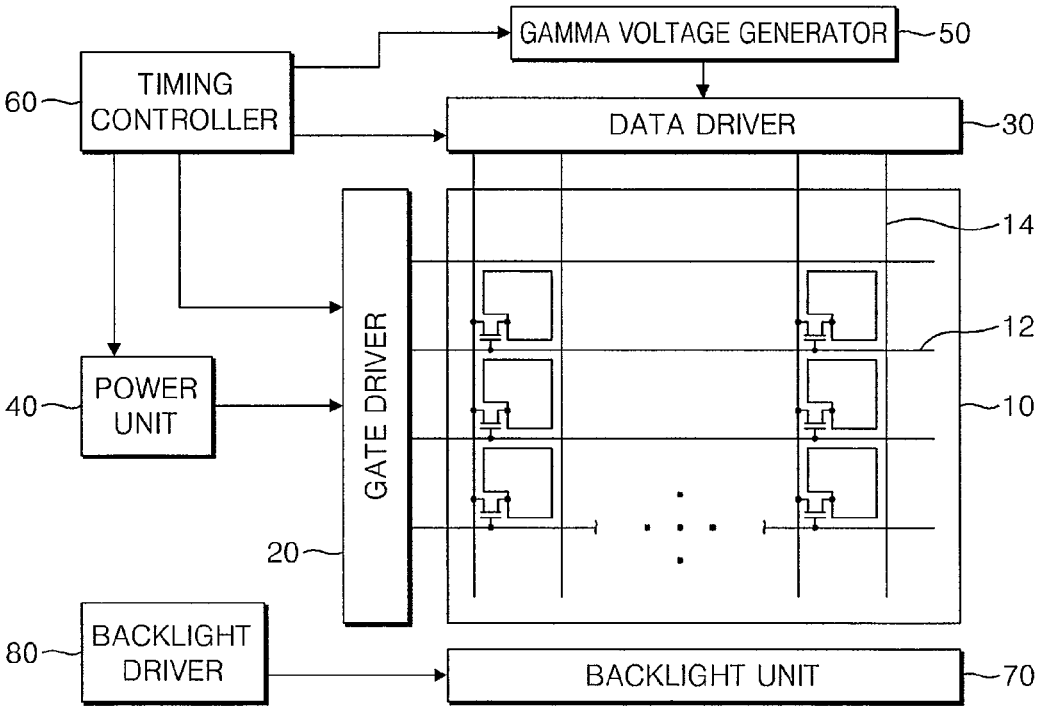
FIG. 6 is a block diagram of a display device according to a second exemplary embodiment of the present invention.

Next, a display device according to a second embodiment of the present invention will be described below. As shown in FIG. 6, the display device includes a display panel 10, a backlight unit 70, a gate driver 20, a data driver 30, a power unit 40, a gamma voltage generator 50, a timing controller 60, and a backlight driver 80.

Since the display panel 10, the gate driver 20, the data driver 30, the power unit 40 and the timing controller 60 are substantially identical to those of the first exemplary embodiment of the present invention, their description will not be repeated below.

The backlight unit 70 is an element that supplies light to the display panel 10. The backlight unit 70 is generally provided on the backside of the display panel 10 to irradiate light toward the display panel 10. As the backlight unit 70 that is a light source generating light, various light sources such as a cold cathode fluorescent lamp (CCFL), an external electrode fluorescent lamp (EEFL), and a light emitting diode (LED) may be used. Moreover, the backlight unit 70 may include various optical films such as a diffusing film, a prism film, a protecting film, etc. to evenly diffuse the light generated from the corresponding light source and thereby improve the luminance.

In the present embodiment, the light source provided in the backlight unit 70 can be turned on and off for a very short period of time. The light source should be capable of maintaining an on-state for a specific time within about 1/60 seconds, i.e., for one frame period displaying an image, and an off-state for the rest time.

The backlight driver 80 maintains the on-state of the backlight unit 70 for a predetermined time within one frame period and the off-state of the backlight unit 70 for the rest time of one frame period. The backlight driver 80 may be provided separately or together with the timing controller 60.

A method of driving the display device according to the present invention will be described below.

Since the driving methods of the timing controller 60, the gate driver 20 and the power unit 40 are substantially the same as those of the first aspect of the present invention, their description will be omitted; however, a description will be given based on the gamma voltage generator 50 and the data driver 30.

Figure 7:
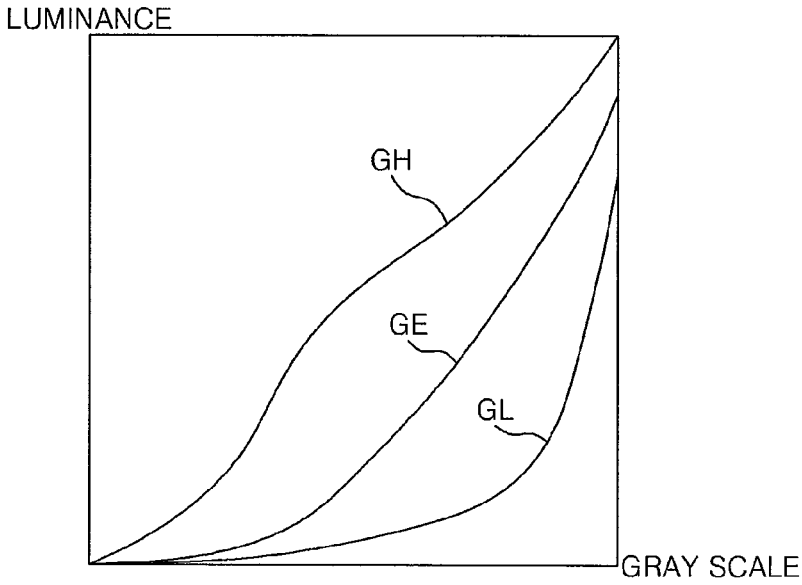
FIG. 7 is a graph illustrating gamma voltages generated from a gamma voltage generator shown in FIG. 6.

First, as shown in FIG. 7, the gamma voltage generator 50 generates two kinds of gray scale voltages including a high gray scale voltage GH and a low gray scale voltage GL. FIG. 7 is a graph illustrating gamma voltages generated from the gamma voltage generator shown in FIG. 6. The high gray scale voltage GH and the low gray scale voltage GL correspond to values obtained by dividing a normal gray scale voltage GE by a gray scale voltage higher than the normal gray scale voltage and by a gray scale voltage lower than the normal gray scale voltage, respectively. That is, the high gray scale voltage GH is higher than the normal gray scale voltage GE, and the low gray scale voltage LH is lower than the normal gray scale voltage GE, in which an average value between the high and low gray scale voltages GH and GL is equal to the normal gray scale voltage GE. In this case, the normal gray scale voltage GE is the common gray scale voltage generated according to a voltage selection control signal applied from the timing controller 60.

The gamma voltage generator 50 according to the present embodiment does not generate the normal gray scale voltage, but generates the high gray scale voltage GH and the low gray scale voltage GL corresponding to the normal gray scale voltage GE. The reason for the generations of the high and low gray scale voltages GH and GL is to solve the lateral visibility asymmetry problem by driving the liquid crystal layer in various ways. The high and low gray scale voltages GH and GL generated by the gamma voltage generator 50 are used to determine an image signal in the data driver 30.

The thus generated two kinds of the gray scale voltages are supplied to the data driver 30. The data driver 30 selects a specific value from the gray scale voltages according to the gray scale signal supplied from the timing controller 60 and then supplies the same to the data line 14 as an image signal.

In the present embodiment, one frame period is divided into two sub-frames to apply different image signals to the respective sub-frames. For convenience of explanation, two sub-frames are referred to as first and second sub-frames SF1 and SF2 in the timing order.

The data driver 30 generates a high gray scale image signal GHS selected at a high gray scale voltage GH and corresponding to the data signal supplied from the timing controller 60. Moreover, the data driver 30 also generates a low gray scale image signal GLS selected at a low gray scale voltage GL and corresponding to the gray scale signal. Accordingly, if the high and low gray scale image signal GHS and GLS, generated from the same gray scale signal, are averaged, the average value between the high and low gray scale image signals GHS and GLS becomes the same as the normal gray scale image signal GES generated from the normal gray scale voltage GE.

Figure 8:
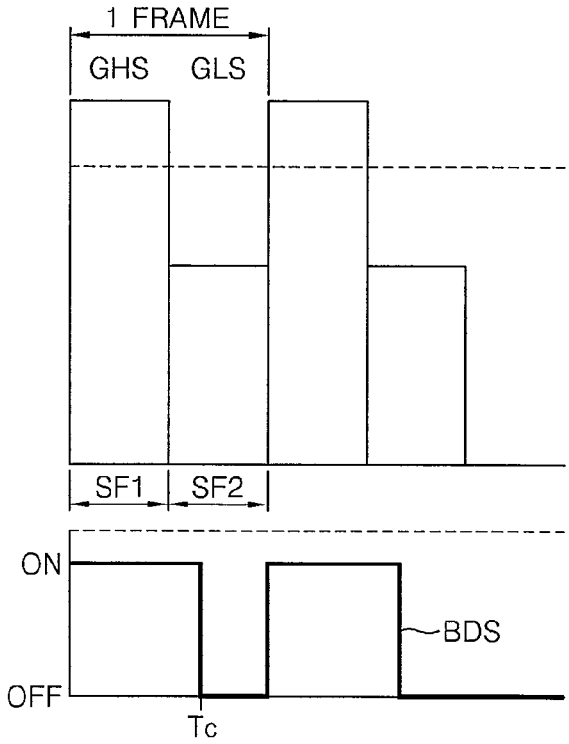
FIG. 8 is configuration diagrams illustrating image signals corresponding to the gamma voltages shown in FIG. 7 and a backlight driving signal generated from a backlight driver shown in FIG. 6.

The thus-generated high and low gray scale image signals GHS and GLS are applied to the first and second sub-frames SF1 and SF2, respectively. For instance, as shown in FIG. 8, the high gray scale image signal GHS is applied to the first sub-frame SF1 and the low gray scale image signal GLS is applied to the second sub-frame SF2. FIG. 8 is configuration diagrams illustrating image signals corresponding to the gamma voltages shown in FIG. 7 and a backlight driving signal generated from the backlight driver shown in FIG. 6. One frame period is divided into two sub-frames and the high and low gray scale image signals GHS and GLS are then applied to the sub-frames, respectively, thus solving the lateral visibility asymmetry problem.

In the present embodiment, the moving image visibility is improved by driving the backlight unit 70 instead of applying a black impulsive signal. As described above, a blackout is needed between an image currently displayed and an image to be displayed in order to improve the moving image visibility. In the first exemplary embodiment of the present invention, the blackout is produced by applying the black impulse signal for the blackout to the image signal itself. Yet, in the second exemplary embodiment of the present invention, the blackout is produced by turning off the backlight unit 70 for a predetermined time in one frame period.

As shown in FIG. 8, the backlight driver 80 generates a backlight driving signal BDS for turning on the backlight unit 70 from a start time point of one frame period to a black impulsive time point Tc and turning off the backlight unit 70 from the black impulsive time point Tc to an end time point of one frame period. If so, the light supply of the backlight unit 70 is interrupted whatever is displayed by the pixels of the display panel 10, thus providing the blackout.

It is preferable that the black impulsive time point Tc be a time point over an intermediate time point of one frame period. Since the backlight unit 70 is turned off from the black impulsive time point Tc, no image is displayed at all. Accordingly, the longer the turning-off time of the backlight unit 70 is, the darker the screen of the display panel. That is, it is preferable that the turning-off time of the backlight unit 70 be reduced by making the impulsive time point Tc closer to the end time point of one frame period, thus improving the luminance of the entire display panel.

As described above, according to the present invention, it is possible to improve the lateral visibility asymmetry problem by applying high and low gray scale image signals within one frame period and improve the moving image visibility by applying the black impulsive signal within one frame period or turning off the backlight unit for a specific time.

Accordingly, the present invention has the advantage of solving both the lateral visibility asymmetry problem caused by the rubbing process and the moving image visibility problem at the same time.

Although the invention has been described with reference to particular embodiments, the description is an example of the invention's application and should not be taken as a limitation. Various adaptations and combinations of the features of the embodiments disclosed are within the scope of the invention as defined by the following claims.

What is claimed is:

1. A display device comprising:

a display panel including gate and data lines arranged in the form of a matrix and displaying an image;

a gate driver driving the gate line;

a data driver supplying a low gray scale image signal, a high gray scale image signal, and a black impulsive signal to the data line within one frame period, wherein the data driver divides one frame period into first to third sub-frames, and supplies one of the low gray scale image signal, the high gray scale image signal and the black impulsive signal at every sub-frame to the data line, and wherein the data driver supplies the black impulsive signal to the last sub-frame in the first to third sub-frames.

2. The display device of claim 1, wherein an average value between the low and high gray scale image signals is equal to a normal gray scale image signal.

3. The display device of claim 2, wherein the low gray scale image signal has a gray luminance value at a gray scale lower than an intermediate gray scale in all gray scales.

4. The method of claim 3, wherein the black impulsive signal has a black gray scale voltage value.

5. The display device of claim 2, wherein the black impulsive signal has a black gray scale voltage value.

6. The display device of claim 1, wherein the low gray scale image signal has a gray luminance value at a gray scale lower than an intermediate gray scale in all gray scales.

7. The display device of claim 1, wherein the black impulsive signal has a black gray scale voltage value.

8. A display device comprising:

a display panel including gate and data lines arranged in the form of a matrix and displaying an image;

a gate driver driving the gate line;

a data driver supplying a low gray scale image signal, a high gray scale image signal, a black impulsive signal and a compensation signal to the data line within one frame period, wherein the data driver divides one frame period into first to fourth sub-frames, selects one of the low gray scale image signal, the high gray scale image signal, the black impulsive signal and a compensation signal corresponding to the black impulsive signal at every sub-frame, and supplies the selected signal to the data line, and wherein the data driver supplies the black impulsive signal to the last sub-frame in the first to third sub-frames.

9. The display device of claim 8, wherein the black impulsive signal has a gray luminance value at a gray scale higher than an intermediate gray scale in all gray scales.

10. The display device of claim 9, wherein an average value between the low and high gray scale image signals is equal to a normal gray scale image signal.

11. The display device of claim 10, wherein the low gray scale image signal has a gray luminance value at a gray scale lower than an intermediate gray scale in all gray scales.

12. The display device of claim 11, wherein the data driver supplies the black impulsive signal to the last sub-frame in the first to fourth sub-frames.

13. The display device of claim 12, wherein an average value between the compensation signal and the black impulsive signal is equal to a normal gray scale image signal.

14. A display device comprising:

a display panel having gate and data lines arranged in the form of a matrix and displaying an image;

a backlight unit supplying light to the display panel;

a gate driver driving the gate line;

a data driver supplying a low gray scale image signal and a high gray scale image signal to the data line within one frame period; and a backlight driver turning off the backlight unit for a predetermined time within the one frame period, wherein the data driver divides one frame period into first and second sub-frames, and applies one of the low gray scale image signal and the high gray scale image signal to each of the sub-frames, and wherein an average value between the low and the high gray scale image signals is equal to a normal gray scale image signal.

15. The display device of claim 14, wherein the low gray scale image signal is supplied to the data line during the first sub-frame and the high gray scale image signal is supplied to the data line during the second sub-frame.

16. The display device of claim 15, wherein the low gray scale image signal has a gray luminance value at a gray scale lower than an intermediate gray scale in all gray scales.

17. The display device of claim 15, wherein the backlight driver turns on the backlight unit from a start time point of one frame period to a black impulsive time point and turns off the backlight unit from the black impulsive time point to an end time point of one frame period.

18. The display device of claim 17, wherein the black impulsive time point is over an intermediate time point of one frame period.

19. A method of driving a display device, the method comprising:

dividing one frame period charging a pixel with a pixel voltage into a plurality of sub-frames;

applying a gray impulsive signal to sub-frames of a first group selected from the plurality of sub-frames; and applying a black impulsive signal to sub-frames of a second group selected from the plurality of sub-frames, different from the first group, wherein the gray impulsive signal includes a low gray scale image signal and a high gray scale image signal, and an average value between the low and high gray scale image signals is equal to a normal gray scale image signal, and wherein the black impulsive signal is applied after the gray impulsive signal is applied.

20. The method of claim 19, wherein the low gray scale image signal has a gray luminance value at a gray scale lower than an intermediate gray scale in all gray scales.

21. The method of claim 20, wherein the black impulsive signal has a black luminance value.

22. The method of claim 21, wherein the sub-frames of the second group are subsequent sub-frames in the one frame period.

23. The method of claim 20, wherein the black impulsive signal includes a black driving signal and a compensation signal.

24. The method of claim 23, wherein the black driving signal has a gray luminance value at a gray scale higher than an intermediate gray scale in all grays scales.

25. The method of claim 24, wherein an average value between the compensation signal and the black driving signal is equal to a normal gray scale image signal.

26. A method of driving a display device, the method comprising:

dividing one frame charging a pixel with a pixel voltage into a first sub-frame and a second sub-frame;

supplying one signal selected from the group consisting of a low gray scale image signal and a high gray scale image signal to each of the sub-frames; and turning off a backlight unit for a specific time in every one frame period, wherein an average value between the low and high gray scale image signals is equal to a normal gray scale image signal.

27. The method of claim 26, wherein the low gray scale image signal has a gray luminance value at a gray scale lower than an intermediate gray scale in all gray scales.

28. The method of claim 26, wherein, in the turning off the backlight unit, the backlight unit is turned on from a start time point of one frame period to a black impulsive time point and turned off from the black impulsive time point to an end time point of one frame period.

29. The method of claim 28, wherein the black impulsive time point is over an intermediate time point of one frame period.

* * * * *